US006176490B1

(12) United States Patent
Brown

(10) Patent No.: US 6,176,490 B1
(45) Date of Patent: Jan. 23, 2001

(54) DOMINO BOARD GAME AND METHOD

(75) Inventor: Lynnette B. Brown, 1153 E. 550 North, Ogden, UT (US) 84404

(73) Assignee: Lynnette B. Brown, Ogden, UT (US)

( * ) Notice: Under 35 U.S.C. 154(b), the term of this patent shall be extended for 0 days.

(21) Appl. No.: 09/359,966

(22) Filed: Jul. 22, 1999

Related U.S. Application Data

(60) Provisional application No. 60/093,973, filed on Jul. 24, 1998.

(51) Int. Cl.[7] ..... A63F 1/02
(52) U.S. Cl. ..... 273/293; 273/236
(58) Field of Search ..... 273/293, 150, 273/151, 236, 148, 309; D21/392, 391, 393, 396–7

(56) References Cited

U.S. PATENT DOCUMENTS

D. 420,709 * 2/1999 Trent .
4,273,338 * 6/1981 Yaeger .
5,346,225 * 9/1994 Walling .

OTHER PUBLICATIONS

"Chickenfoot, The Fascinating Game for All Ages, for All the Family and Friends", board game instructions; Plastech Industries Co., Fort Worth, Texas; 1986, 2 pages.

"12 Domino Game Instructions, featuring Cardinal Mexican Train," board game instructions; Cardinal Industries, Inc., Long Island, New York; 1994, 2 pages.

* cited by examiner

*Primary Examiner*—Jeanette Chapman
*Assistant Examiner*—V K Mendiratta
(74) *Attorney, Agent, or Firm*—Lynnette B. Brown

(57) ABSTRACT

A multi-player board game for use with dominos has a board with a plurality of notches disposed around the peripheral edge of the board. The board further has token areas disposed on the surface. Each token area is disposed adjacent to a corresponding notch. Each token area has a corresponding token. Each notch, token area, and token corresponds to a player. During the game, a domino may be placed in the notches. A placed domino starts a train or string of dominoes. Matching dominoes are placed next to previously placed dominoes to extend the length of the trains. Players continue taking turns until a player eliminates all of their respective dominos. A player places a token on the player's corresponding token area to indicate that the domino train issuing from the corresponding notch is playable by any of the opponents. At certain times, a player may remove the token from the player's corresponding token area to indicate that the domino train is non-playable by opponents. That is, an opponent may not add to that player's domino train. Play continues until a player has matched all of the player's dominoes.

6 Claims, 4 Drawing Sheets

DOMINO BOARD GAME AND METHOD

RELATED APPLICATIONS

This application claims priority to Provisional Patent application Ser. No. 60/093,973, filed Jul. 24, 1998 Expired.

BACKGROUND OF THE INVENTION

1. The Field of the Invention

The invention relates to the field of recreational board games and more particularly to an apparatus and method for innovative play of domino playing pieces.

2. The Background Art

Numerous games utilizing dominoes have been enjoyed by many as pleasant recreational past times. Such games enjoy the benefit of being simple to play, requiring an element of chance, while still having a degree of mental concentration. For generations domino games have provided opportunities for social and family interaction.

The basic concept of domino games is to eliminate or reduce the number of dominos that a player has in the player's possession by matching them to dominoes previously laid. Several dominoes are thereby linked to one another as players take turns to match their respective dominoes. Typically, only dominoes on the beginning or end of a domino string may be matched. However, in other variations intermediate dominoes may be matched. In yet other variations, a plurality of domino strings may be created. Typically, players are not able to dictate which strings of dominos may be utilized by other players.

It is an object of the invention to provide an added element of player involvement by allowing players the opportunity to control playability of certain domino strings.

It is an additional object of the invention to provide a domino game with visual indicators of playable domino strings to facilitate game play.

Such an invention is disclosed and claimed herein.

BRIEF SUMMARY OF THE INVENTION

The invention comprises a domino board game for use with multiple players. In one embodiment, the board game comprises a substantially flat surface configured in a circular shape. The board game further has a plurality of notches disposed around the peripheral edge of the surface. A plurality of token areas are configured on the surface. Each token area is disposed adjacent to a corresponding notch. The game of the present invention further uses a plurality of dominoes and a plurality of tokens. Each player commences with a number of dominoes. The object of the game is to match and thereby eliminate as many dominoes as possible to achieve a favorable score.

Each notch, token area, and token corresponds to a player except for one notch, token area, and token which are designated as universal and may be played by any player. During the game, a domino may be placed in a notch. A placed domino positioned in a notch starts a train or string of dominoes. Matching dominoes are then placed next to previously placed dominoes to extend the length of the trains. Players take turns matching and placing dominos until a player eliminates all of their respective dominos.

During game play, a player places a token on the player's corresponding token area to indicate that the domino train issuing from the corresponding notch is playable by any of the opponents. At certain times, a player may remove the token from the player's corresponding token area to indicate that the domino train is non-playable by opponents. That is, an opponent may not add to that player's domino train.

The universal token remains on the universal token area through out game play. This indicates that the domino train in the corresponding notch is playable by all players throughout the game.

Thus, the game of the present invention adds the interactive element of player manipulation to periodically prevent use of certain domino trains.

BRIEF DESCRIPTION OF THE DRAWINGS

In order that the manner in the advantages and features of the invention are obtained, a more particular description of the invention summarized above will be rendered by reference to the appended drawings. Understanding that these drawings only provide selected embodiments of the invention and are not therefore to be considered limiting of its scope, the invention will be described and explained with additional specificity and detail through the use of the accompanying drawings in which.

DETAILED DESCRIPTION OF THE PREFERRED EMBODIMENTS

Figure 1:
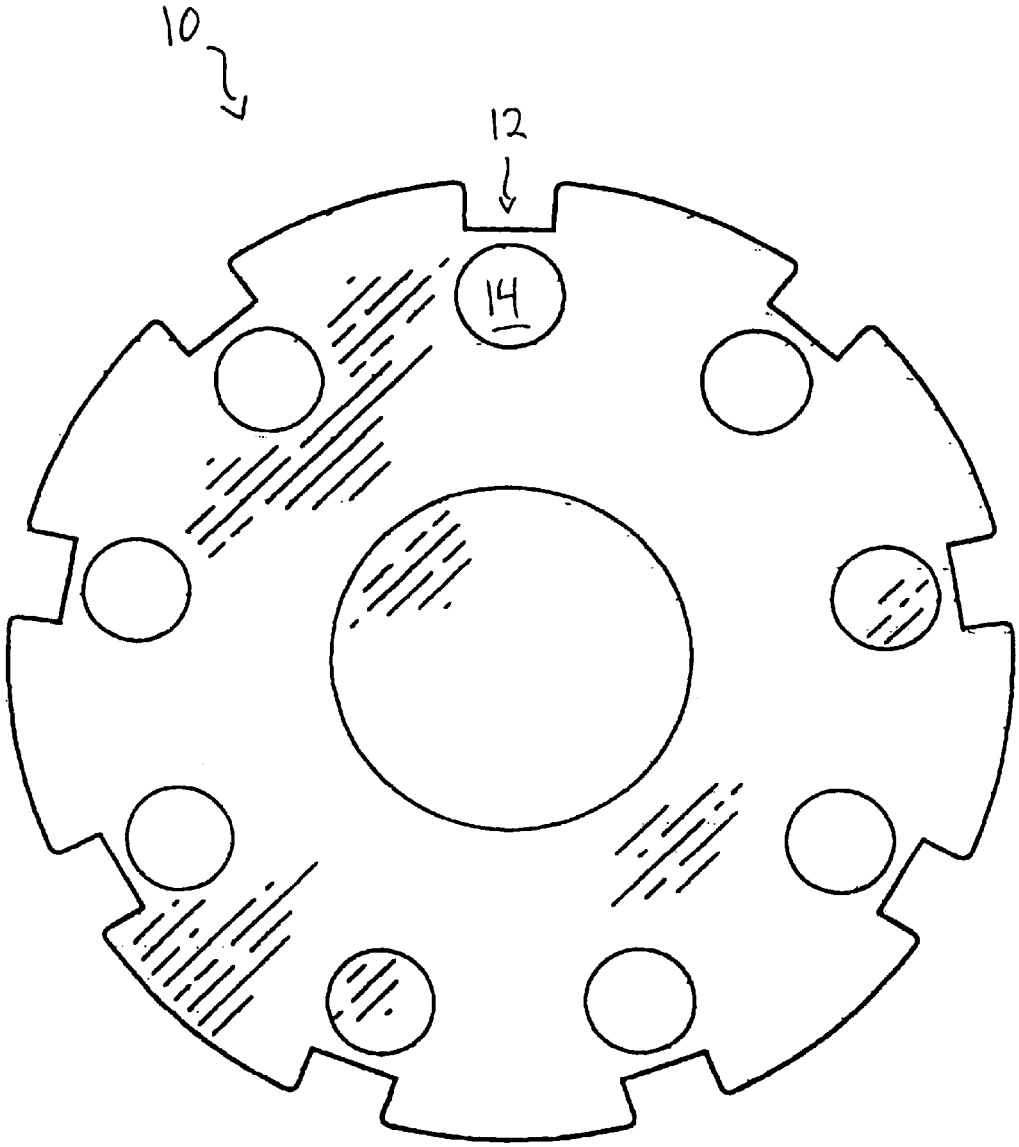
FIG. 1 is a top plan view of one presently preferred embodiment of the playing side of a game board of the present invention.
Figure 2:
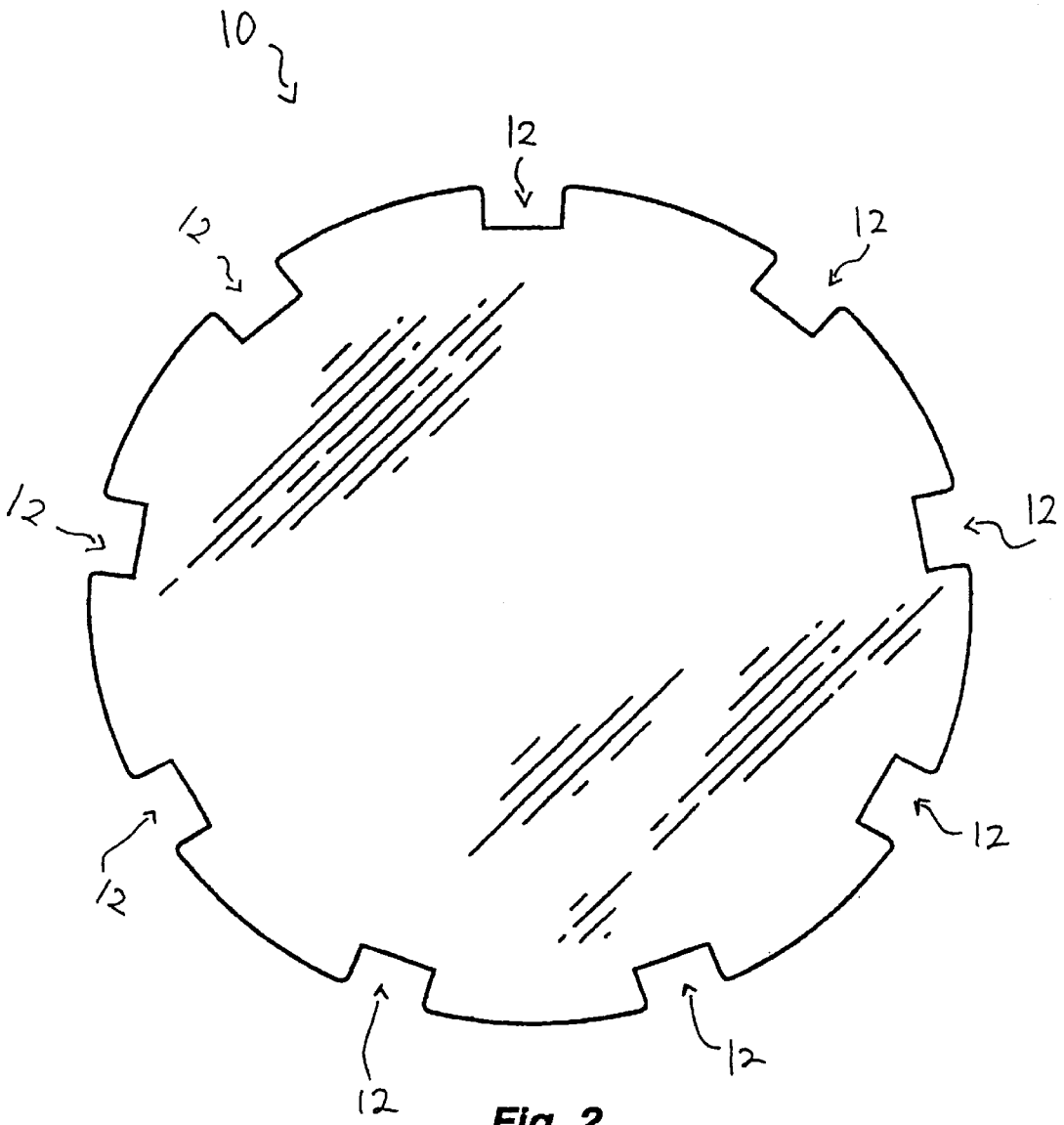
FIG. 2 is a plan view of the opposing side of the game board of FIG. 1.
Figure 3:
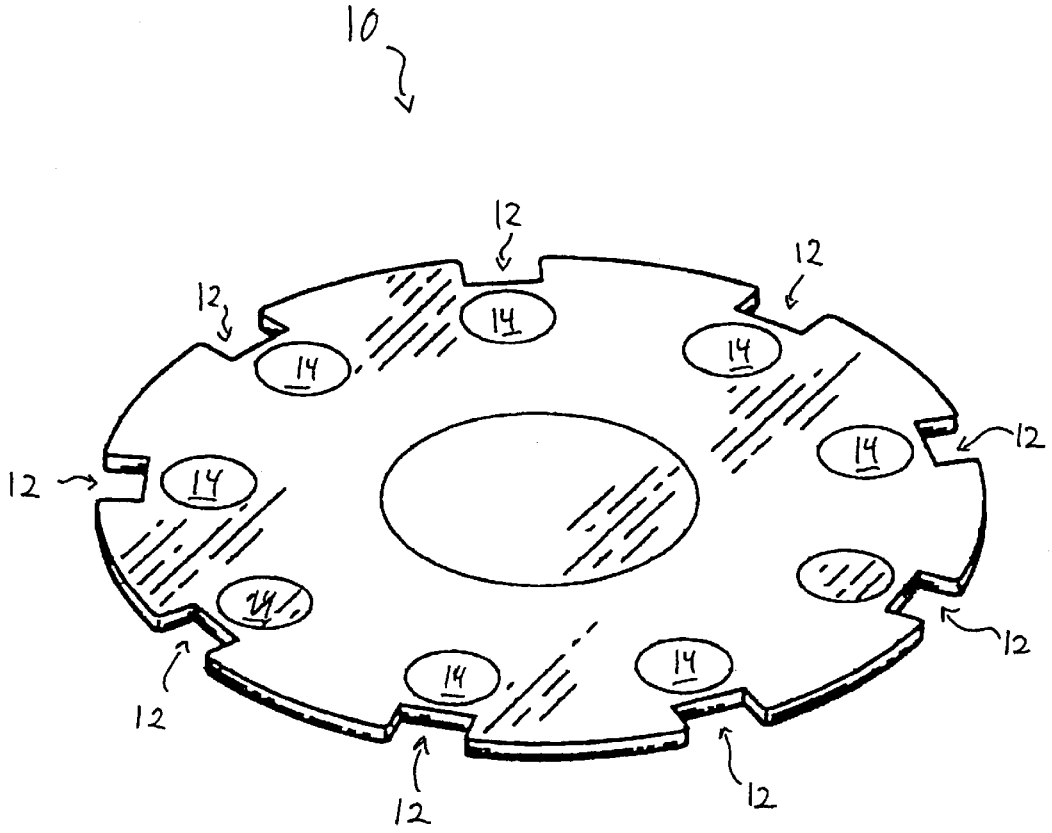
FIG. 3 is a perspective view of the game board of FIGS. 1 and 2.

The presently preferred embodiments of the present invention will be best understood by reference to the drawings, wherein like parts are designated by like numerals throughout. It will be readily understood that the components of the present invention, as generally described and illustrated in the figures herein, could be arranged and designed in a wide variety of different configurations. Thus, the following more detailed description of the embodiments of the apparatus, system, and method of the present invention, as represented in FIGS. 1 through 3, is not intended to limit the scope of the invention, as claimed, but is merely representative of certain presently preferred embodiments of the invention. The game of the present invention is for 2 to 8 players and is played with a set of conventional dominoes such as double nine or double twelve dominoes.

The game of the present invention comprises a game board 10 as shown in FIGS. 1 through 3. The game board 10 is used to indicate starting positions for lines of dominoes. In one embodiment, the board 10 is circular in configuration with a plurality of notches 12. One of skill in the art will appreciate that the game board 10 may be embodied in a variety of configurations and still be within the scope of the invention. In one embodiment, the game board 10 is configured with nine notches 12. Up to eight notches 12 are used for individual game players. The ninth notch 12 is reserved as a universal notch as will be explained in further detail below.

The notches 12 indicate the placement of dominoes for starting positions for each player. From the starting position a player builds a string or train of dominoes. A train is formed by placing dominoes end-to-end such that matching like numbers are adjacent one another.

The game board 10 is further used for placement of player tokens on a token area 14. Each player has a token area 14 which corresponds to that players notch 12 or starting position. Thus, one token area 14 and one notch 12 corresponds to each player. Furthermore, one token area 14 and one notch 12 are designated as a universal token area and a universal notch for a universal domino train. In one presently preferred embodiment, there are nine token areas 14 and nine notches 12 to accommodate 2 to 8 players plus the additional universal domino train.

The game of the present invention further comprises 8 player tokens, 1 universal token, and a score pad. The tokens may be embodied in a variety of formats depending on the desired theme. In one presently preferred embodiment, each player token is embodied as a "train engine" to maintain a train theme for game play.

The player tokens are placed on and off the game board 10 at different times throughout game play. A player's token on a token area 14 indicates to other players that they may make a play on that player's train of dominoes. A play is defined as the player matching a domino to the last domino in the train to thereby eliminate the domino from the player's possession. The player's train, of course, commences from the notch 12 corresponding to the token area 14. When a player's token is not on the board 10, other players may not make a play on that player's train or line of dominoes.

The universal token represents a train of dominoes upon which any player may make a play at anytime. The universal token is placed on a universal token area 14 not assigned to a player and always remains on the game board 10. The notch 12 adjacent to the token area 14 assigned to the special token indicates the starting position the universal train of dominoes upon which any player may play.

The method of the game is now explained with reference to the previously disclosed components of the game. Play preparation begins with all dominoes shuffled and positioned face down. Each player draws one domino. The player with the highest number of total dots on the player's domino is the first to start. The dominoes are gathered to form a pile. Play begins with the selected first player and rotates to the left of the first player to the next player.

Each player's token is placed on a corresponding token area 14 on the board 10 which is adjacent to the player. The universal token is also placed on the board 10 on a token area 14 which is not designated to a player.

All players draw from the pile a select number of dominoes and place the dominoes in front of them. Preferably the dot side of the dominoes are positioned to be unseen by their opponents. The select number of dominoes varies depending on the number of players and may be as follows: 2 to 4 players draw 10, 5–6 players draw 8, and 7–8 players draw 5.

All player tokens and the universal token are placed on the token areas 14 to commence the main game activity. Each round is started with a different number, beginning with 0 (blank), then 1, 2, 3, 4, etc., through 9, in consecutive order. In the first round, a blank (0) is required to start a train. Thus, the first player checks the first player's dominoes for a blank or double blank domino. The blank, of course, is representative of 0. If the first player does not have a blank, then rotating to the left, the next player who does have a blank will start. If no one is holding a blank, then it is the first player's turn again.

In the next round, the first player looks for a 1 (single dot domino). This continues with a 2 in the next round and etc. in consecutive order until one of the players can start the play. On the next round, the player to the left of the first player looks for the lowest unused number to play until all numbers, 0–9, have all been used. The number of the domino used may be crossed off as it is used on the score pad. In the last few rounds, when most of the numbers have been used, it may be necessary for players to draw extra dominoes until an unused number is drawn.

A player's train commences by placing a domino with the designated starting number in the notch 12 in the board 10 corresponding to the player's token area 14. If a player plays on 0 his own domino train, then after a player's turn, the player removes the player's token from the board 10 to prevent an opponent from playing on the player's train. A player may, on a player's turn, start any opponent's train but can remove the player's token only when starting the player's own train. Once started, player's trains and the universal train are played on by placing like numbers dominoes end-to-end.

If on a player's turn, a player is unable to play on an opponent's train or the universal train, then the player must put the player's token back on the board 10 on the player's token area 14. This enables opponents to play on the player's train. The player must also draw a domino from the pile and add it to the player's hand. If a player draws a domino that a player can use, the player must wait until the player's next turn to use it.

When the player is able to add to the player's train again, the player may remove the player's token again. If a player neglects to remove the player's token from the board 10 and an opponent makes a play on the player's train, then the player must leave the player's token on the board 10 until the player is able to play on it again. Players may play on their own trains, or play on the universal train on any turn. However, players may only play on other players' trains when those players' tokens are on the game board 10.

In one embodiment, a player who has a double domino may choose to place it sideways on an opponent's train that ends in the same number regardless of whether that opponent's token is on the board 10 or not, and declare a "derail" situation. The universal train of dominoes may not be derailed. The player who creates the derail situation is defined as a derailer. The player whose train experiences the derail situation is referenced herein as a derailee. In the derail situation all players, except the derailer, must put their tokens back on the board 10.

The derailer, if able, may play a second domino and the derailee loses a turn. If the second domino played by the derailer is another derail the derailer may play a third domino. The limit is 3 dominos being played per any one turn.

As a player lays down a player's second to last domino in a train, the player must indicate this action to all other players. This may be done by the player making a statement such as "Last Stop" to let the other players know that the player has only one domino left. If that player fails to do so, and an opponent confronts the player as to how many dominoes the player has left, the opponent may give the forgetful player one of the opponent's dominoes. If, by doing so, the opponent is now down to one domino, the opponent must remember to quickly announce a "Last Stop" or another player may catch the opponent in the same way. If that is an opponent's last domino, the opponent wins that stage.

In one embodiment, the method of play involves 10 stages in the game. The object of each stage is to be the first player to use all of an individual player's dominoes. A stage is completed when a player has eliminated all the player's dominoes. This player is considered to have won this particular stage. At the end of the stage, scores are tallied by counting the number of dots on the dominos retained by each player. A score for that stage is then recorded for each player on the score pad. After all stages are played the scores for all the stages are tallied for each player. The player with the lowest score wins.

Figure 4:
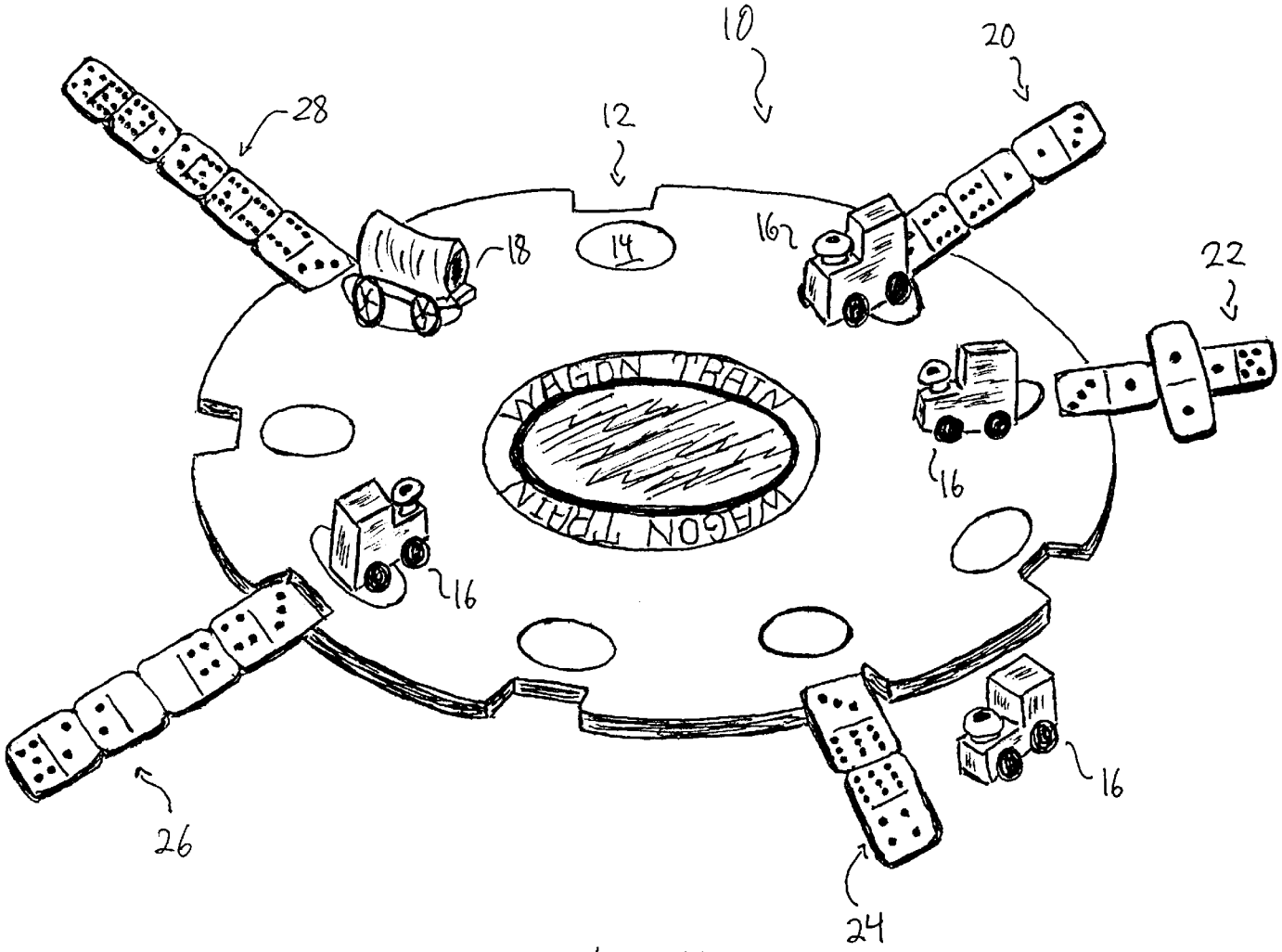
FIG. 4 is a perspective view of one embodiment of the game board with accompanying tokens and dominos.

Referring to FIG. 4, the game board 10 is shown as it may exist during game play with accompanying player tokens 16. The universal token 18 is also shown and is embodied to be distinct from the player tokens 16 to identify its universal designation. FIG. 4 represents four players with five domino trains 20, 22, 24, 26, 28: four player domino trains 20, 22, 24, 26 and one universal domino train 28. Domino train 24 may not be played by opponents as indicated by the accompanying player token 16 being removed from the board 10.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A method for playing a game of dominoes, comprising:

providing a game board having a plurality of notches disposed around a peripheral edge of the board and a plurality of token areas disposed on a surface of the game board, wherein each token area is disposed adjacent to a corresponding notch;

placing a first domino in a first notch to commence a first domino train;

placing a player token on one of the plurality of token areas corresponding to the first notch to indicate playability by opponents of the first domino train in the corresponding first notch;

removing a player token from the first token area to indicate non-playability by opponents of the first domino train; and placing additional dominoes in the first domino train to thereby extend the length of the first domino train, wherein the additional dominoes are placed adjacent to matching previously placed dominoes.

2. The method of claim 1 further comprising:

designating one of the plurality of notches as a universal notch and the corresponding token area as a universal token area; positioning a universal token on the universal token area to indicate playability of a universal domino train commencing in the universal notch.

3. The method of claim 1 wherein the game board comprises nine notches and nine token areas.

4. A method for playing a game of dominoes, comprising:

providing a game board having a plurality of notches disposed around a peripheral edge of the board and a plurality of token areas disposed on a surface of the board, wherein each token area is disposed adjacent to a corresponding notch;

placing dominoes in the plurality of notches to create corresponding domino trains;

placing player tokens on the plurality of token areas to indicate playability by opponents of corresponding domino trains;

removing player tokens from the plurality of token areas to indicate non-playability by opponents of corresponding domino trains; and adding matching dominos to previously placed dominos to thereby extend the length of the domino trains.

5. The method of claim 4 further comprising:

designating one of the plurality of notches as a universal notch and the corresponding token area as a universal token area; positioning a universal token on the universal token area to indicate playability of a universal domino train commencing in the universal notch.

6. The method of claim 4 wherein the game board comprises nine notches and nine token areas.

* * * * *